US012188750B2

(12) United States Patent
Ellis et al.

(10) Patent No.: US 12,188,750 B2
(45) **Date of Patent: *Jan. 7, 2025**

(54) BULLET CAPTURING BALLISTIC SLUGS

(71) Applicant: Alternative Ballistics Corporation, Las Vegas, CA (US)

(72) Inventors: Christian Ellis, San Diego, CA (US); Benjamin Weinrib, El Cajon, CA (US)

(73) Assignee: Alternative Ballistics Corporation, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/499,714

(22) Filed: Nov. 1, 2023

(65) Prior Publication Data

US 2024/0060756 A1 Feb. 22, 2024

Related U.S. Application Data

(63) Continuation of application No. 18/146,953, filed on Dec. 27, 2022, now Pat. No. 11,835,322, which is a continuation of application No. 17/644,060, filed on Dec. 13, 2021, now Pat. No. 11,566,876.

(51) Int. Cl.

| | |
|---|---|
| ***F42B 10/48*** | (2006.01) |
| ***F41A 21/32*** | (2006.01) |
| ***F42B 12/02*** | (2006.01) |
| ***F42B 12/74*** | (2006.01) |

(52) U.S. Cl.

CPC ..... *F42B 12/02* (2013.01); *F41A 21/325* (2013.01); *F42B 10/48* (2013.01); *F42B 12/74* (2013.01)

(58) Field of Classification Search

CPC ..... F42B 30/06; F42B 12/02; F42B 10/48; F41A 21/325; F41J 13/00

See application file for complete search history.

(56) References Cited

U.S. PATENT DOCUMENTS

| | | | |
|---|---|---|---|
| 1,900,790 | A | 3/1933 | Brandt |
| 3,389,425 | A | 6/1968 | Termet |
| 3,491,693 | A | 1/1970 | Streckfuss |
| 3,620,162 | A | 11/1971 | King |
| 3,664,263 | A | 5/1972 | Driscoll |

(Continued)

FOREIGN PATENT DOCUMENTS

| | | | |
|---|---|---|---|
| EP | 0762075 | A1 | 3/1997 |
| FR | 604510 | A | 5/1926 |

(Continued)

*Primary Examiner* — J. Woodrow Eldred

(74) *Attorney, Agent, or Firm* — Lynch LLP; Sean Lynch

(57) ABSTRACT

The inventive subject matter is directed to systems and apparatuses that are designed to work in cooperation with a firearm such that the firearm can fire a less lethal projectile. Systems can include a mounting device that clips onto a firearm, where that mounting device also include mounting posts. The mounting posts protrude from an end of the mounting device, and the mounting posts are designed to couple with mounting holes on an associated slug. Slugs of the inventive subject matter thus feature mounting holes and a center-bored hole that is designed to capture a bullet that is fired from a firearm that the system is coupled to. When a bullet is captured by a slug, an inelastic collision takes place that causes the slug to leave the firearm at around 20% of the bullet's original speed.

16 Claims, 3 Drawing Sheets

(56) References Cited

U.S. PATENT DOCUMENTS

| | | | | |
|---|---|---|---|---|
| 3,726,036 | A | 4/1973 | Jennings | |
| 3,733,727 | A | 5/1973 | Jones | |
| 3,791,303 | A | 2/1974 | Sweeney | |
| 3,898,932 | A | 8/1975 | Flatau | |
| 3,951,070 | A | 4/1976 | Flatau | |
| 3,982,489 | A | 9/1976 | Flatau | |
| 4,013,011 | A | 3/1977 | Gabriels | |
| 4,030,421 | A | 6/1977 | Litman | |
| 4,190,476 | A | 2/1980 | Flatau | |
| 4,505,179 | A | 3/1985 | Nelson | |
| 4,506,604 | A | 3/1985 | Hughes | |
| 4,567,831 | A | 2/1986 | Gordon | |
| 4,747,349 | A | 5/1988 | Schilling | |
| 4,776,255 | A | 10/1988 | Smith | |
| 4,793,259 | A | 12/1988 | Ambrosi | |
| 4,799,906 | A | 1/1989 | Perkins | |
| 4,823,702 | A | 4/1989 | Woolsey | |
| 4,908,971 | A | 3/1990 | Chaney | |
| 5,099,747 | A | 3/1992 | Smith | |
| 5,257,936 | A | 11/1993 | Ambrosi | |
| 5,349,906 | A | 9/1994 | Devaux | |
| 5,377,438 | A | 1/1995 | Sheinfeld | |
| 5,448,937 | A | 9/1995 | Buc | |
| 5,574,245 | A | 11/1996 | Buc | |
| 5,654,524 | A | 8/1997 | Saxby | |
| 6,378,439 | B1 | 4/2002 | Saxby | |
| 6,408,765 | B1 | 6/2002 | Tauber | |
| 6,523,478 | B1 | 2/2003 | Gonzalez | |
| 6,619,179 | B2 | 9/2003 | Mika | |
| 6,688,032 | B1 | 2/2004 | Gonzalez | |
| 6,981,449 | B2 | 1/2006 | Sadeck | |
| 7,296,375 | B2 | 11/2007 | Brunn | |
| 7,526,999 | B1 | 5/2009 | Timan | |
| 8,701,325 | B1 * | 4/2014 | Rayner | F42B 12/50 42/105 |
| 9,494,396 | B2 | 11/2016 | Peter | |
| 11,566,876 | B1 * | 1/2023 | Ellis | F42B 12/74 |
| 11,835,322 | B2 * | 12/2023 | Ellis | F41A 21/325 |
| 2003/0019352 | A1 | 1/2003 | Mika | |
| 2004/0069177 | A1 | 4/2004 | Klein | |
| 2015/0260494 | A1 | 9/2015 | Peter | |
| 2016/0178305 | A1 | 6/2016 | Ellis | |
| 2018/0292163 | A1 * | 10/2018 | Ellis | F42B 12/02 |

FOREIGN PATENT DOCUMENTS

| | | | |
|---|---|---|---|
| WO | 2001011305 | A2 | 2/2001 |
| WO | 2013177603 | A1 | 12/2013 |

* cited by examiner

BULLET CAPTURING BALLISTIC SLUGS

This application claims priority to and is a continuation of U.S. patent application Ser. No. 18/146,953, filed Dec. 27, 2022, which claims priority to and is a continuation of U.S. patent application Ser. No. 17/644,060, filed Dec. 13, 2021. All extrinsic materials identified in this application are incorporated by reference in their entirety.

FIELD OF THE INVENTION

The field of the invention is less lethal ballistics.

BACKGROUND

The background description includes information that may be useful in understanding the present invention. It is not an admission that any of the information provided in this application is prior art or relevant to the presently claimed invention, or that any publication specifically or implicitly referenced is prior art.

Law enforcement around the world needs better alternatives to lethal force. There have been many efforts made to create less-lethal tools to facilitate in law enforcement activities. For example, tasers and specialized firearms that shoot pepper balls or rubber balls have been put into use in many situations. But there is an inherent disadvantage to creating entirely new tools that an officer must carry with them to carry out their jobs. This can, for example, increase the chance of an officer grabbing the wrong tool.

This gives rise to a need for a less lethal alternative to a firearm that does not also require an officer to carry an increasing number of tools. One way to do this is to create an attachment for firearms that converts the firearm to be less lethal. This must be done using a device that does not compromise safety and does not complicate use of the firearm.

Past efforts have also failed to consider advantages in a system that fire a less lethal projectile that immediately return the firearm to a lethal state for any subsequent trigger pulls. This gives, for example, law enforcement officers a chance to neutralize a target without using lethal force while ensuring lethal force is immediately available thereafter.

Thus, there is still a need in the art for attachments for firearms that convert those firearms into less lethal tools.

SUMMARY OF THE INVENTION

The present invention provides apparatuses, systems, and methods in which slugs are designed to capture bullets shot from firearms. In one aspect of the inventive subject matter, a ballistic slug for use with a firearm comprises: a spherically-shaped body comprising a metal; a set of mounting holes, where each mounting hole comprises mounting hole tapered sidewalls, and the mounting hole tapered sidewalls taper according to a first apex angle; a center-bored hole having circular cross-sections, where the center-bored hole comprises center-bored hole tapered sidewalls, and the center-bored hole tapered sidewalls taper according to a second apex angle; and the center-bored hole is configured to capture a bullet fired by the firearm.

In some embodiments, the center-bored hole has an angular bottom portion that can be described by a third apex angle. The third apex angle of the center-bored hole can be between 90° and 140° (or less than 180°, in some embodiments). Each mounting hole in the set of mounting holes can also feature a counter sink. In some embodiments, the first apex angle is between 0.5° and 3°. The second apex angle can be between 0.5° and 3°. In some embodiments, the metal can include an aluminum alloy.

In another aspect of the inventive subject matter, a ballistic slug system for a firearm comprises a ballistic slug and as mounting device. The ballistic slug includes: a spherically-shaped body comprising a metal; a set of mounting holes, where each mounting hole comprises mounting hole tapered sidewalls, and the mounting hole tapered sidewalls taper according to a first apex angle; a center-bored hole having circular cross-sections, where the center-bored hole comprises center-bored hole tapered sidewalls, and the center-bored hole tapered sidewalls taper according to a second apex angle, and where the center-bored hole is configured to capture a bullet fired by the firearm. The mounting device comprising: a body configured to clip onto a barrel of a firearm where the body has a front surface; and a set of mounting posts protruding from the front surface, where each mounting post from the set of mounting posts is configured to fit at least partially into each mounting hole from the set of mounting holes. Each mounting post is configured to couple with each mounting hole by pressure fit.

In some embodiments, the center-bored hole further comprises an angular bottom portion having a third apex angle, where the third apex angle can be between 90° and 140° (or less than 180°). Each mounting hole in the set of mounting holes can additionally include a counter sink. In some embodiments, the first apex angle is between 0.5° and 3°, and the second apex angle can be between 0.5° and 3°. The metal can include an aluminum alloy.

One should appreciate that the disclosed subject matter provides many advantageous technical effects including an ability to capture a bullet shot from a firearm such that the capturing slug moves around 20% slower than the bullet, making it a less lethal projectile. Embodiments also facilitate access to lethal projectiles after a less lethal projectile is fired.

Various objects, features, aspects, and advantages of the inventive subject matter will become more apparent from the following detailed description of preferred embodiments, along with the accompanying drawing figures in which like numerals represent like components.

DETAILED DESCRIPTION

Figure 1:
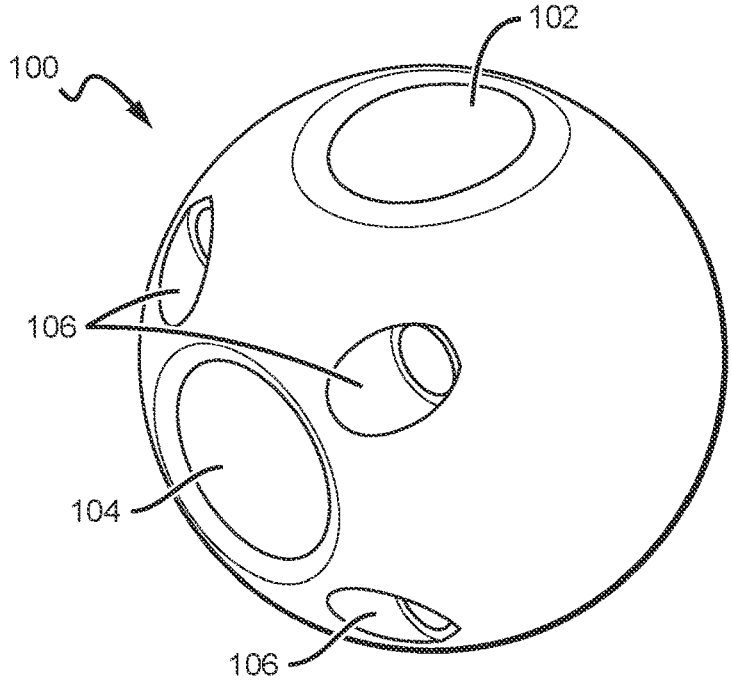
FIG. 1 is an isometric view of a slug of the inventive subject matter.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities used to describe and claim certain embodiments of the invention are to be understood as being modified in some instances by the term "about," "approximate," etc. Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Embodiments of the inventive subject matter are directed to slugs that are used in association with firearms. These slugs are designed to capture a bullet that is shot out of a firearm and to, via inelastic collision, absorb energy from that bullet resulting in the slug being fired away from the firearm. Slugs are designed to be less lethal, traveling at a fraction of the speed of a bullet. For example, in some embodiments a slug that has captured a bullet can travel at, e.g., 15%-40% (preferably around 20%) of the speed of that bullet before it is captured. To hold a slug in position prior to firing, each slug is coupled with a mounting device. Such a mounting device is designed to ensure the slug is held in position relative to a firearm while minimizing risk of either the slug falling off the mounting device or the mounting device falling off the firearm prior to firing. Once a firearm is fired and a bullet is captured by a slug, the mounting device to which a slug is attached is ejected from the firearm bringing the firearm back into a lethal state. In instances where, e.g., a mounting device is not ejected, the firearm is still returned to a lethal state when there is no slug mounted to the mounting device to capture a subsequently fired bullet.

FIG. 1 shows slug 100 in an isometric view. Slug 100 is shown to be generally spherical, though other shapes are contemplated including cubic, rectangular prisms, ellipsoids, etc. In this view, slug 100 can be seen having a dimple 102 on its surface. Dimple 102 is configured to facilitate aiming down the sights of a firearm without visual interference from slug 100. In some embodiments, slug 100 could have a large enough outer diameter that a portion of slug 100 could rise above a top portion of a firearm such that it obstructs an operator's view when looking down the firearm's sights, and dimple 102 solves this issue. It is contemplated that slugs of the inventive subject matter can range from 0.75" to 1.5" in diameter, depending on, e.g., the firearm and bullet.

A center-bored hole 104 is also visible in this view. Center-bored hole 104 is configured to capture a bullet that is shot out of a firearm. Mounting holes 106 are also visible in this view. In the embodiment shown in FIG. 1, there are four mounting holes 106, though only three are visible. Mounting holes 106 allow slug 100 to be coupled with a mounting device (shown in FIG. 3) that holds slug 100 in front of a firearm's barrel.

Slug 100 is formed as a sphere for several reasons. Aerodynamically, a predominantly spherical projectile is more likely to travel predictably considering slug 100 is not fired directly from a barrel that can bring advantages such as rifling for improved accuracy. Another reason for a spherical shape is that it is designed to minimize harm to a target. For example, in applications such as law enforcement, slugs of the inventive subject matter are intended to operate as less lethal alternatives to unmodified firearms. A spherical shape increases a surface area that contacts a target upon impact while also eliminating any edges or corners, thereby working to distribute forces that result from such an impact.

A mass of slug 100 depends on a variety of factors, including mass and speed of travel of a bullet a slug is intended to capture. Adjusting slug mass, in turn, adjusts slug speed upon capturing a bullet as a result of the physics of inelastic collisions.

Figure 2:
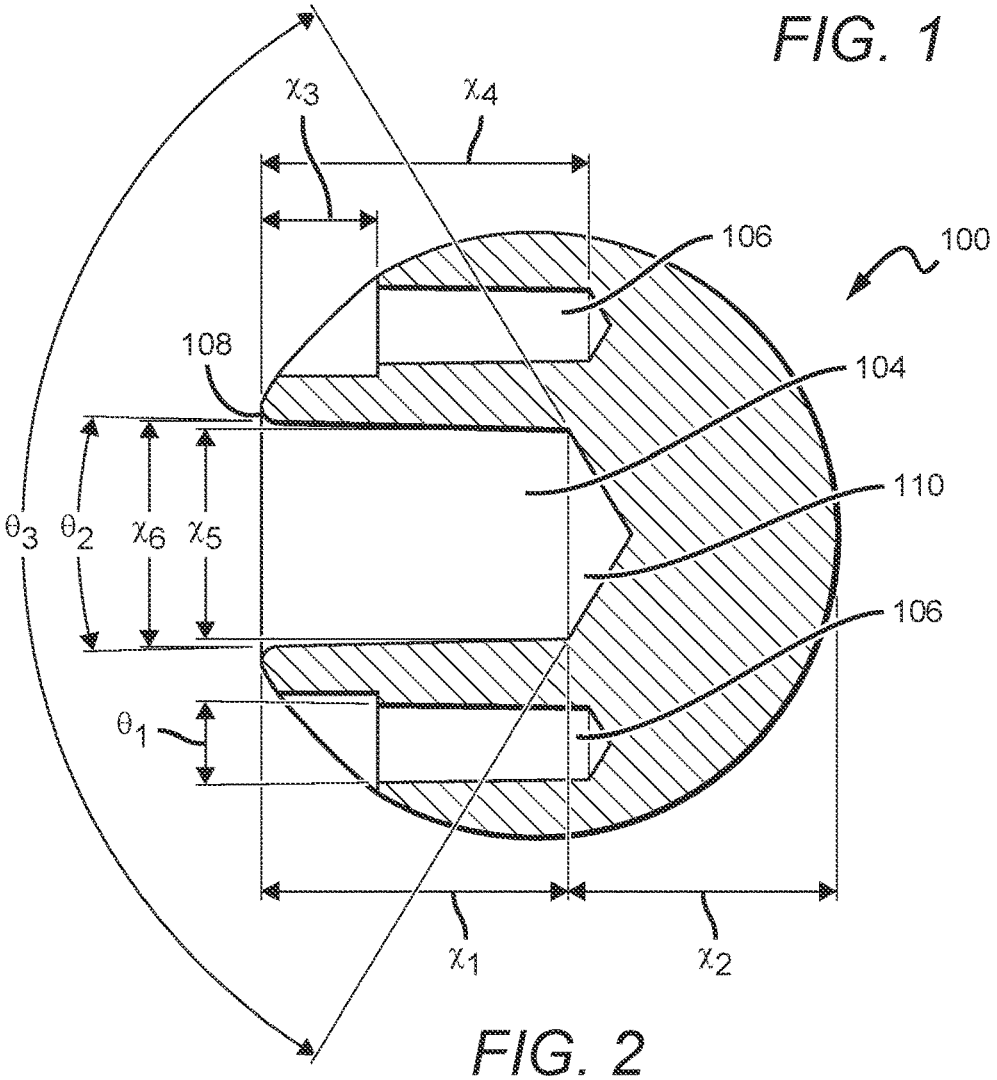
FIG. 2 is a side, cutaway view thereof.

FIG. 2 shows a cutaway view of slug 100. This view shows additional detail relating to both the center-bored hole 104 as well as mounting holes 106. Center-bored hole 104 of slug 100 features a tapered internal structure, such that center-bored hole 104 gets narrower as its depth increases (e.g., like a cone that is missing its apex). Mounting holes 106 feature a similar taper as well as a counter sink (or a counter bore, in some embodiments). Counter sinking for mounting holes 106 make it easier to mount slug 100 onto a mounting device (again, shown in FIG. 3). Similarly, center-bored hole 104 can include a filleted edge 108. Filleted edge 108 can help a bullet enter into center-bored hole 104 by eliminating edges that could otherwise catch a bullet as it leaves a barrel in instances where, e.g., center-bored hole 104 is not well-aligned with a firearm's barrel. Thus, both the center-bored hole and the mounting holes can feature circular cross-sections, as shown in, e.g., FIG. 6.

Center-bored hole 104 can be drilled down to a depth of $x_1$, where $x_1$ is between 0.30" and 0.75", depending on what firearm or ammunition slug 100 is designed to be used with. Opposite $x_1$ is $x_2$, which measures a distance between a depth of the center-bored hole 104 and an opposite side of slug. A magnitude of $x_2$ can therefore depend on an overall diameter of slug 100 as well as a magnitude of $x_1$. In some embodiments, $x_2$ can have a magnitude of 0.30"-0.75". In some embodiments, counter sinks at mounting holes 106 can be drilled down to a depth of $x_3$, where $x_3$ can range from 0.10" to 0.35". Finally, $x_4$ is a depth for mounting holes 106, and it can range from 0.50" to 0.75". Example measurements for different slugs designed for use with different firearms are included below.

In additional to depths, mounting holes 106 and center-bored hole 104 also have taper angles. Mounting hole tapers are described according to $\theta_1$, and center-bored hole taper is described according to $\theta_2$. $\theta_1$, $\theta_2$, and $\theta_3$ can all also be described as apex angles, since they describe an angle between two sidewalls of a cone at its apex, and each tapered hole can be described as a cone. In some embodiments, $\theta_2$ is between 1.5° and 2.5° (2° in some preferred embodiments). In some embodiments, $\theta_2$ can be less than 3° and even less than 1.5° down to as little as 0.5° (e.g., 0.5°-3°).

Figure 3:
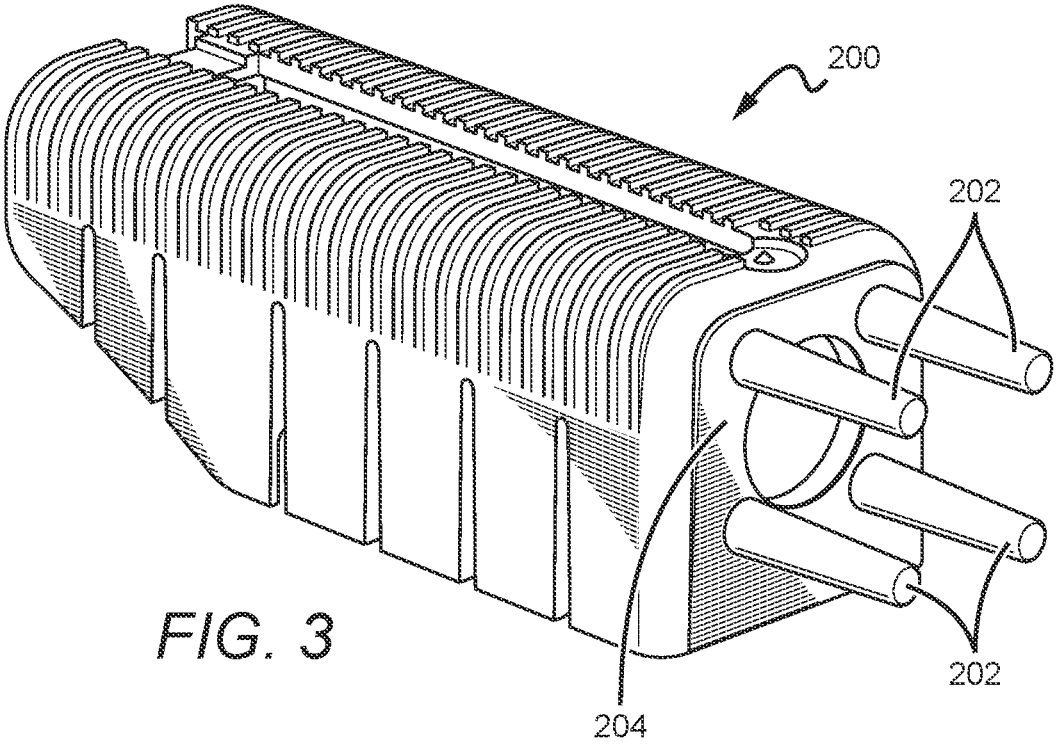
FIG. 3 shows a mounting device of the inventive subject matter.

Mounting hole tapers are designed to facilitate coupling slug 100 to a mounting device 200 as shown in FIG. 3. Mounting hole tapers are described according to apex angle $\theta_1$, which can range from 0.5°-3°. Mounting device 200 includes a plurality of mounting posts 202. Mounting posts 202 protrude away from front surface 204 of mounting device 200 such that each mounting post 202 is normal to front surface 204 and each mounting post 202 is parallel to each other mounting post 202. Mounting posts 202 are designed such that their outer diameter is larger than the smallest inner diameter of each mounting hole, as dictated by apex angle $\theta_1$. The smallest diameter of center-bored hole 104 is described by $x_5$ and the largest diameter of center-bored hole 104 is described by $x_6$. Thus, for example, if a mounting hole's taper takes it from 0.145" down to 0.135", it follows that an outer diameter of a mounting post 202 should be between 0.145" and 0.135" (e.g., 0.140"). In embodiments, for example, where this outer diameter occurs at an end of a mounting post, that would cause the mounting post to create a pressure fit with a corresponding mounting hole at half the mounting hole's total depth (assuming a linear taper).

Figure 6:
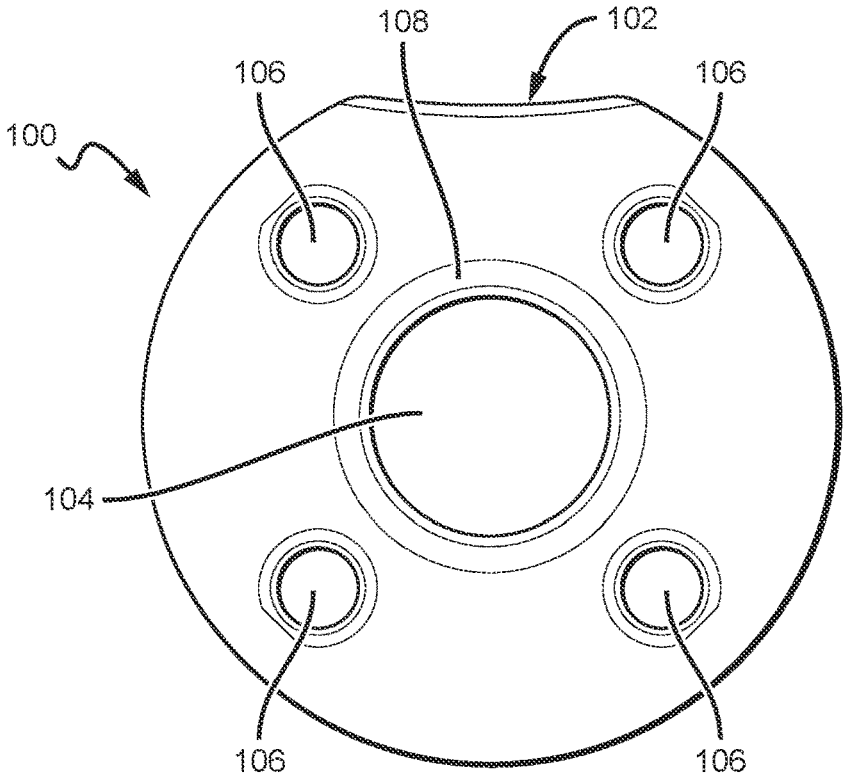
FIG. 6 shows a rear view of a slug.

Finally, mounting holes 106 can be spaced apart from one another in standardized ways such that mounting posts and mounting holes can be matched to one another. Mounting holes and mounting post spacing can also depend on the firearm for which a slug is designed. For example, mounting holes on a slug designed to work with 9 mm rounds can be spaced apart such that the slug can only couple with a mounting device that fits to a handgun that can shoot 9 mm rounds. In some embodiments one of the mounting posts can have a different diameter or cross-sectional shape than the others. Including a difference to one of the mounting posts can, e.g., enforce proper slug orientation and ensure the slug is matched correctly to a firearm's ammunition. In some embodiments, mounting holes are configured to be disposed on a slug in a square configuration around the center-bored hole (e.g., as shown in FIG. 6), where that square configuration matches a square configuration of mounting posts on a mounting device.

Figure 4:
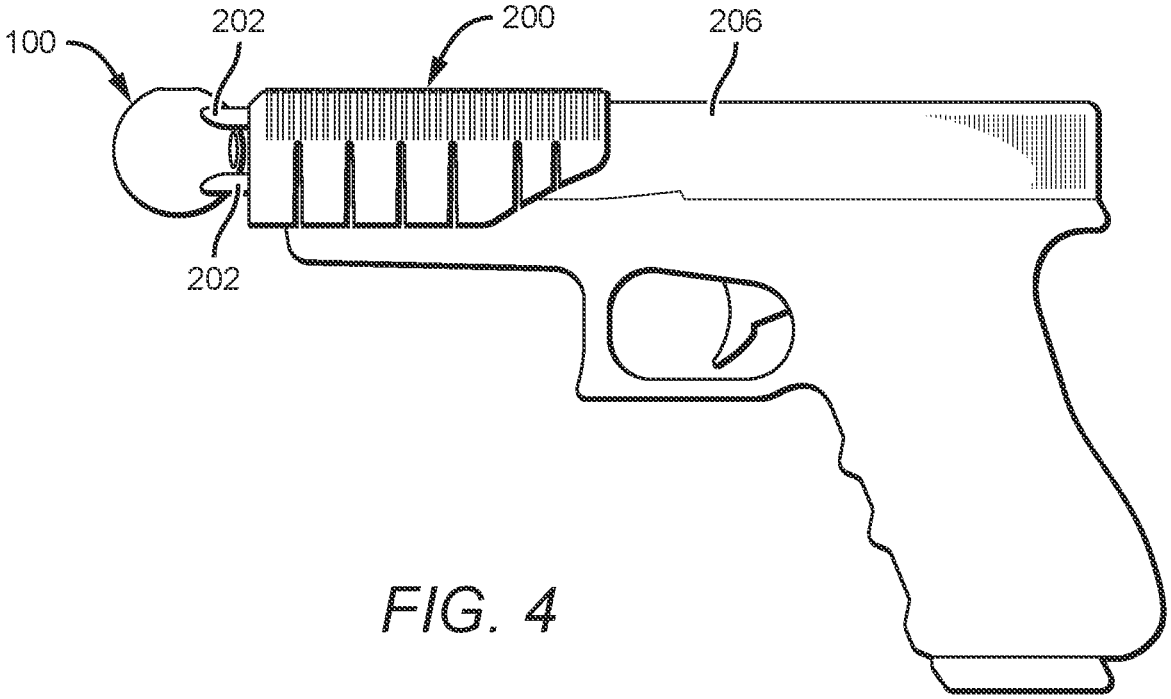
FIG. 4 shows a firearm with a mounting device and slug attached.

Taper angle $\theta_2$ of center-bored hole 104 is included to improve performance of slug 100 as a bullet impacts its interior. When a bullet is shot out of a firearm, it leaves the firearm's barrel 206 and then comes into contact with slug 100. FIG. 4 shows where slug 100 is positioned relative to a firearm's barrel 206 (i.e., directly in front). Because making components that are, e.g., made from plastic and able to be clipped onto a firearm can be difficult to manufacture with extreme precision, it is advantageous to make the center-bored hole of a slug tapered such that it narrows as its depth increases. With a taper, the opening of the center-bored hole has a larger diameter than its diameter at the bottom. Thus, the opening portion is sized and dimensioned to be larger than a bullet that a slug is designed to receive. The apex angle of the center-bored hole is selected such that performance is maximized (e.g., the bullet is guided to the bottom of the center-bored hole while minimizing undesirable effects such as a bullet impacting a sidewall causing the slug to spin in a way that causes unpredictability of flight).

Moreover, it has also been discovered that by including a taper in center-bored holes of slugs of the inventive subject matter, bullets fired into those slugs are more likely to reach the bottoms of those center-bored holes, thereby improving accuracy and consistency. One reason for this is that even if a bullet enters a slug slightly off-center, the tapered walls of the center-bored hole nevertheless guide that bullet to the bottom of the center-bored hole (or, more likely, as the bullet travels, it causes the slug to shift as the bullet moves through it), where the bullet impacts and an inelastic collision occurs. In addition to tapered sidewalls, centered-bored hole 104 also features an angular bottom portion 110, where the angle of the bottom portion is described by $\theta_3$. $\theta_3$ can range from, e.g., 90°-140° (preferably 110°). This tapered bottom portion of slug 100 improves performance of slug 100 by ensuring a bullet impacts slug 100 at a center portion of center-bored hole 104. In some embodiments, the impact site is designed to be off-set from the slug's spherical center such that bullet 112 impacts slug 100 at a portion of slug 100 that is further from the firearm's barrel than the slug's spherical center. In other embodiments, the impact site is designed to be at center or off-center toward the firearm's barrel. Thus, depth as measured by $x_1$ results in a depth of center-bored hole that ends in different locations relative to the slug's spherical center.

Slugs of the inventive subject matter can additionally include one or more coatings. Coatings can apply a color to a slug to give the slug a distinct visual appearance. For example, some slugs can feature an orange coating to emphasize the less lethal nature of the slugs or to make the slugs easier to see for a variety of other reasons. Similarly, mounting device 200 shown in FIG. 3 can also be created to feature selected visual features such as bright colors (e.g., orange or yellow). These colors can serve as important identifiers to indicate that a firearm having a mounting device coupled thereto is configured to deliver a less lethal ballistic slug instead of a lethal bullet.

Figure 5:
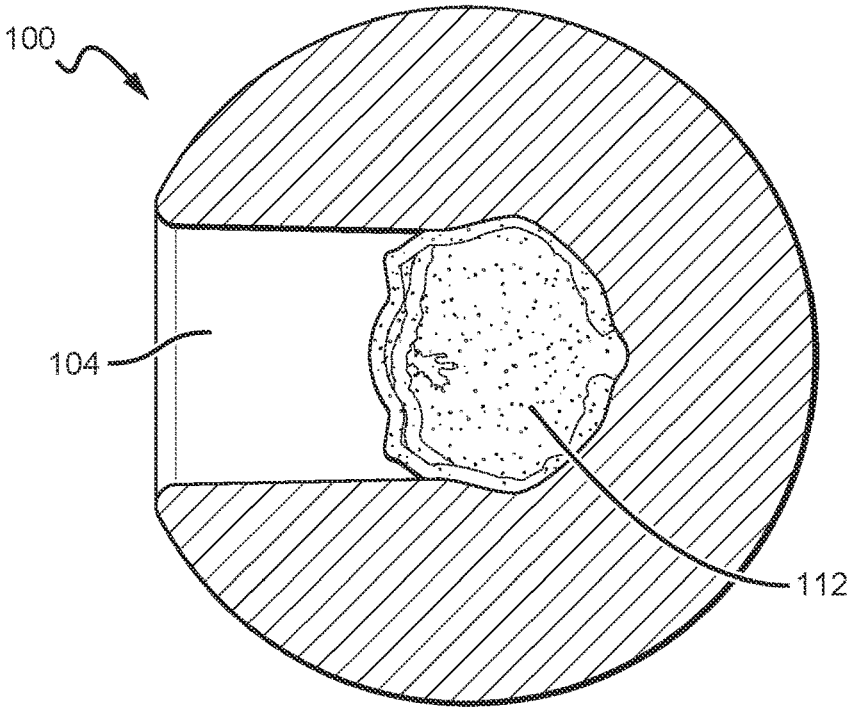
FIG. 5 shows a side, cutaway view of a slug with a captured bullet.

FIG. 5 shows a cutaway view of slug 100 with a bullet 112 fired into center-bored hole 104. Upon impact with the bottom portion of center-bored hole 104, bullet 112 compresses and expands laterally, creating an impact chamber that widens beyond the diameter of the bottom portion of center-bored hole 104. In doing so, bullet 112 combines with slug 100 such that it cannot be easily removed, thereby preventing the bullet from ejecting out of slug 100 after the impact. FIG. 6 show slug 100 from a rear view. In FIG. 6, center-bored hole 104 and mounting holes 106 are all visible. From this view, dimple 102 is also visible.

Slugs of the inventive subject matter can be designed for use with different firearms and ammunition. Table 1, below, comprises technical specifications for several different bullets. It is contemplated that each measurement in Table 1 should be understood to be approximate and subject to manufacturing and machining tolerances. Moreover, each value is also variable depending on bullet size. The inventive subject matter is not limited by the provided dimensions. It should be understood that values described in Table 1 are intended to describe ranges between them (e.g., any mass between 30 g and 54 g are expressly contemplated). Moreover, each value should be understood as being bounded by an acceptable range of values of ±25%. For example, the slug described as having a 30 g mass should be understood as disclosing a range of masses from 22.5 g to 37.5 g (i.e., 75% of 30 g at the lower bound and 125% of 30 g at the upper bound). This applies to all values described in the table below.

Materials for slugs of the inventive subject matter include materials like aluminum, which are strong while also soft enough to capture a bullet such that, in most cases, it cannot be ejected after impact. For example, Aluminum 6061 has the following material properties: density of 2.70 g/cm$^3$; Young's modulus of 68 GPa; tensile strength 124-290 MPa; elongation at break 12-25%; and Poisson's ratio 0.33. It should be understood that, in some embodiments, different metals (including, e.g., aluminum alloys) can be used, where the material properties are similar to those listed above. For example, each material property listed above can be understood to disclose a range of acceptable material property values, where that range is ±25% of the stated value. For example, the Young's modulus can be 51 GPa through 85 GPa (which is 68 GPa±25%). Any value disclosed in Table 1 can create similarly bounded ranges.

TABLE 1

| Ammunition | 9 mm | 0.40 Caliber | 0.45 Caliber |
|---|---|---|---|
| Material | 6061-T6 ALUMINUM ALLOY | 6061-T6 ALUMINUM ALLOY | 6061-T6 ALUMINUM ALLOY |
| Mass | 30 g | 42 g ± 0.5 | 54 g ± 0.5 |
| Outer Ø | 1.165" ± 0.005 | 1.160" ± 0.005 | 1.391" ± 0.005 |
| x1 | 0.59" | 0.59" | 0.59" |
| x2 | 0.5" | 0.5" | 0.7" |
| x3 | 0.340" | 0.340" | 0.340" |
| x4 | 0.630" | 0.630" | 0.630" |
| x5 | 0.408" ± 0.002 | 0.408" ± 0.002 | 0.408" ± 0.002 |
| x6 | 0.438" ± 0.002 | 0.458" ± 0.002 | 0.438" ± 0.002 |
| θ1 | 2° | 2° | 2° |
| θ2 | 3.07° | 3.07° | 3.07° |
| θ3 | 118° | 118° | 118° |
| Coating 1 | n/a | AXALTA, SKY WHITE-PFW510S9 | AXALTA, SKY WHITE-PFW510S9 |
| Coating 2 | n/a | TIGER DYRLAC, FLORESCENT ORANGE-49/24080 | TIGER DYRLAC, FLORESCENT ORANGE-49/24080 |

Thus, specific systems and methods of less lethal ballistics have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A ballistic slug for use with a firearm comprising:
a slug body comprising a set of mounting holes and a bored hole between the set of mounting holes; and
wherein the bored hole is configured to capture a bullet fired by the firearm.

2. The ballistic slug of claim 1, wherein the bored hole comprises a tapered sidewall.

3. The ballistic slug of claim 2, wherein the tapered sidewall tapers according to an apex angle that is between 0.5° and 3°.

4. The ballistic slug of claim 1, wherein each mounting hole further comprises a counter sink.

5. The ballistic slug of claim 1, wherein each mounting hole comprises a mounting hole tapered sidewall, and each of the mounting hole tapered sidewalls tapers according to an apex angle that is between 0.5° and 3°.

6. The ballistic slug of claim 1, wherein the slug body is spherically-shaped.

7. A ballistic slug system for a firearm comprising:
a slug body comprising:
a set of mounting holes; and
a center hole;
a mounting device comprising:
a body configured to clip onto the firearm;
a set of mounting posts; and
wherein each mounting post from the set of mounting posts is configured to fit at least partially into each mounting hole from the set of mounting holes.

8. The ballistic slug of claim 7, wherein the center hole comprises a tapered sidewall.

9. The ballistic slug of claim 8, wherein and the bored hole tapered sidewall tapers according to an apex angle that is between 0.5° and 3°.

10. The ballistic slug of claim 7, wherein each mounting hole in the set of mounting holes comprises a mounting hole tapered sidewall.

11. The ballistic slug of claim 10, wherein the mounting hole tapered sidewall tapers according to an apex angle that is between 0.5° and 3°.

12. The ballistic slug of claim 7, wherein slug body comprises an aluminum alloy.

13. A ballistic slug for use with a firearm comprising:
a slug body comprising at least one mounting hole and a bullet capture hole; and
wherein the bullet capture hole is configured to receive a bullet fired by the firearm.

14. The ballistic slug of claim 13, wherein the slug body is spherical.

15. The ballistic slug of claim 13, wherein the at least one mounting hole comprises a circular cross-section.

16. The ballistic slug of claim 13, wherein bullet capture hole comprises a circular cross-section.

* * * * *